United States Patent [19]

Bower et al.

[11] 4,232,727

[45] Nov. 11, 1980

[54] METHOD AND APPARATUS FOR THE CONTINUOUS PRODUCTION OF STRIP

[75] Inventors: Terry F. Bower, Needham; M. Ronald Randlett; George Shinopulos, both of Burlington, all of Mass.

[73] Assignee: Kennecott Copper Corporation, New York, N.Y.

[21] Appl. No.: 956,793

[22] Filed: Nov. 1, 1978

Related U.S. Application Data

[63] Continuation-in-part of Ser. No. 928,881, Jul. 28, 1978.

[51] Int. Cl.[3] ..... B22D 11/12; B21B 1/44; B21B 13/22

[52] U.S. Cl. ..... 164/76; 148/2; 164/417

[58] Field of Search ..... 164/417, 76, 83, 416, 164/418; 148/2; 72/366; 226/118; 242/45, 147 R; 29/527.7

[56] References Cited

U.S. PATENT DOCUMENTS

| | | | |
|---|---|---|---|
| 988,444 | 4/1911 | Corley et al. | 242/45 |
| 1,816,909 | 8/1931 | Larson | 242/45 X |
| 2,135,183 | 11/1938 | Junghans | 164/416 |
| 2,459,064 | 1/1949 | Davis | 242/45 |
| 2,553,921 | 5/1951 | Jordan | 164/85 |
| 2,682,997 | 7/1954 | Magnuson et al. | 242/45 X |
| 3,307,230 | 3/1967 | Goss | 164/417 X |
| 3,353,730 | 11/1967 | Lang | 226/118 X |
| 3,542,304 | 11/1970 | Willis et al. | 242/45 X |

FOREIGN PATENT DOCUMENTS

| | | | |
|---|---|---|---|
| 1087626 | 10/1967 | United Kingdom | 164/440 X |

OTHER PUBLICATIONS

W. Schmitz-Stegor, "Rolling of Bar, Rod, and Section: Copper and Copper Alloys," Metals Technology, Jul.-Aug. 1975, pp. 382-395.

*Primary Examiner*—Robert Louis Spruill
*Assistant Examiner*—Gus T. Hampilos
*Attorney, Agent, or Firm*—John L. Sniado; Anthony M. Lorusso

[57] ABSTRACT

Disclosed is apparatus and method for integrated, continuous, high speed manufacture of metallic strip, especially brass, from a melt. The apparatus comprises a chilled casting mold in liquid communication with a melt and means for drawing a rod through the mold in a pattern of forward and reverse strokes. After emergence from the mold, the rod speed is regulated to a substantially constant value before conversion into strip. In this embodiment, the casting mold is stationary; the rod is drawn through the mold by driven rolls programmed to create the desired forward and reverse motion of the rod through the mold. Creating substantially constant speed is accomplished by allowing slack to develop through the lateral deflection of the rod. In another embodiment, the casting mold oscillates as the rod is withdrawn at a substantially constant speed so further rod motion regulation is unnecessary. Conversion of the rod to strip comprises flattening in a hot rolling mill, and quenching. In accordance with known procedures the produced strip can be further reduced in cross section in a cold rolling mill if desired.

23 Claims, 4 Drawing Figures

METHOD AND APPARATUS FOR THE CONTINUOUS PRODUCTION OF STRIP

CROSS REFERENCE TO A RELATED APPLICATION

This application is a continuation-in-part of co-pending application Ser. No. 928,881, filed July 28, 1978, the teachings of which are incorporated herein by reference.

BACKGROUND OF THE INVENTION

This invention relates to the manufacture of metallic strip and more particularly to the apparatus and method for integrated, continuous, high speed manufacture of finished metallic strip from a metallic melt.

It is well known in the art to cast indefinite lengths of metallic rods or strands from a melt by drawing the melt through a cooled mold. Known casting techniques include downcasting, horizontal or inclined casting and upcasting. Co-pending application Ser. No. 928,881 of which this application is a continuation-in-part, discloses a mold assembly and method for the continuous up-casting of high quality metallic rods, particularly those of copper and copper alloys including brass, at production speeds many times faster than those previously attainable with closed mold systems.

The manner in which the casting is drawn through the chilled mold is an important aspect of the casting process. A cycle of forward and reverse strokes makes possible the production of high quality rods by aiding the formation of the casting skin, preventing casting termination, and compensating for contraction of the casting within the die as it cools. The pattern of cast withdrawal as disclosed in co-pending application Ser. No. 928,881 allows for exceptionally high casting speeds. The intermittent nature of the casting withdrawal, however, has precluded an integrated, continuous process for converting the cast rod to finished strip, for example, because the rolling mills for such a conversion from rod to strip require the working material to be moving at a uniform velocity if heavy reductions are to be made.

Conventional techniques for producing brass strip, for example, are cumbersome and time consuming. Often, more than forty separate steps are required to produce a finished thin strip taking as long as forty days, including waiting time between processing machines.

It is, therefore, an object of the present invention to provide an apparatus and method for the integrated, continuous high speed production of high quality, hot rolled metallic strip starting from a melt.

It is another object of the present invention to provide such an apparatus, compact in size, which costs much less than conventional strip-making installations and which operates at a much higher throughput rate.

A still further object is to provide such an apparatus capable of producing very thin metallic strips at much less cost than possible with conventional techniques.

SUMMARY OF THE INVENTION

The apparatus for integrated, continuous, high speed manufacture of finished metallic strip from a melt, typically of copper or copper alloy such as brass comprises two elements. The first is a casting apparatus, such as a mold assembly as disclosed in co-pending application Ser. No. 928,881, capable of high speed production of high quality rod. The casting apparatus includes means for creating the forward and reverse strokes and any attendant dwell period necessary for the proper casting of the rod.

The second element is the processing section for the continuous conversion of the rod into hot rolled strip.

In one important embodiment, the rod casting means comprises a stationary casting chilled mold in liquid communication with a melt. A driven withdrawal roll in conjunction with a pinch roll draws the rod through the mold in a pattern of forward and reverse strokes to form a casting skin in an effective manner. These same rolls also serve to flatten the rod, thereby converting it into hot rolled strip.

In another embodiment, the rod casting means comprises a stationary casting chilled mold in liquid communication with a melt. A driven withdrawal roll in conjunction with a pinch roll draws the rod through the mold in a pattern of forward and reverse strokes. Upon emergence from these rolls, the rod velocity, therefore, is varying. For example, for $\frac{3}{4}$ inch diameter rod, the net withdrawal speed is preferably in excess of eighty inches per minute with a stroke frequency of approximately 1 to 3 hertz. Forward strokes are typically long, such as 1 to $1\frac{1}{2}$ inches, with a high forward velocity of three to twenty inches per second and a high acceleration in excess of gravity (1 g). The reverse strokes are typically short, such as 0.08 to 0.13 inch, also with high acceleration, typically 3 g. A brief dwell period (e.g., 0.1 second) can be introduced at the end of either or both strokes.

For processing of the rod into hot rolled strip, the speed of the rod, varying just beyond the driven rolls, is regulated to a substantially constant value for further processing into strip. According to the present invention as manifest by this embodiment, regulation of rod motion is accomplished by first changing the direction of travel of the rod after the rod emerges from the rolls. In this embodiment, the direction of travel is changed by 70°–110°, preferably 90°, by guiding the rod through a plurality of guide rolls arranged on an arcuate path. This change in direction of travel makes it possible for slack to develop through lateral deflection of the rod near the midpoint of the arcuate path. The slack is accommodated by one or more pairs of rolls located near the midpoint of the arcuate path. These disc-like rolls have deeply recessed grooves in their circumferential faces. The rolls thus restrain the rod in a direction parallel to the axis of the rolls while allowing lateral deflection of the rod in a direction perpendicular to the rolls' axis, thereby permitting the slack necessary for smoothing out the rod's intermittent motion. It should be noted that the slack in the rod is monitored by a transducer which maintains synchronization of the rolling mill speed to equal the net forward casting speed multiplied by a reduction constant. In this way the magnitude of lateral deflection is bounded. Beyond the slack accommodating rolls, straightening rolls guide the rod at substantially constant velocity to the processing stations for converting the rod to hot rolled strip.

These processing stations include a reheating station for raising the temperature of the rod for hot rolling, if necessary, at least one hot rolling mill for flattening the rod into strip, a quench chamber for cooling the strip and a winder for coiling the finished strip. In addition to these stations, other procedures may be carried out such as cold rolling and annealing, as required. For example, additional hot and cold rolling mills are employed for the production of thin strip material, down to 0.01 inch or less. One or more edgers for controlling strip width along with an edge milling unit for shaping the edge may be necessary as well. Of course, a reheater is only necessary when the temperature of rod drops to below the hot rolling range.

Brushes for cleaning the strip surface before cold rolling and various gauges for measuring the strip width, thickness and flatness may also be required. The finished strip is then coiled by winder. The whole process from melt to solid hot rolled strip takes approximately one minute to complete.

In yet another embodiment the rod casting means comprises a casting, chilled mold in liquid communication with a melt. The mold is arranged to oscillate with respect to a fixed reference position in the direction of travel of the rod through the mold. A pair of rolls pulling the rod at substantially constant speed advances the rod from the mold at a substantially constant speed with respect to a fixed reference position. The combination of mold oscillation and the constant withdrawal speed of the rod, both with respect to a fixed reference position, creates the pattern of forward and reverse strokes necessary for high speed casting of high quality rod. In this embodiment, hydraulic means are employed to oscillate the mold. Mold oscillation may be programmed to include a dwell period of zero relative motion between rod and mold in addition to the forward and reverse strokes. The same stroke profile as described for the stationary mold embodiment may be implemented.

Because the rod is being advanced at a constant speed relative to a fixed position (the strokes being provided by mold oscillation), no change in direction of rod travel is necessary as in one stationary mold embodiment. Of course the direction of rod travel may be changed to accommodate building constraints. Thus, the rod proceeds directly to the processing stations for conversion into strip. As in the stationary mold embodiment, the processing stations also include at least a quench chamber, and a winder for coiling the hot rolled strip product. It should be noted that the withdrawal rolls of the caster may perform the hot rolling.

These and other objects and features of the invention will become apparent to those skilled in the art from the following detailed description which should be read in light of the accompanying drawing.

DESCRIPTION OF THE PREFERRED EMBODIMENTS

Figure 1:
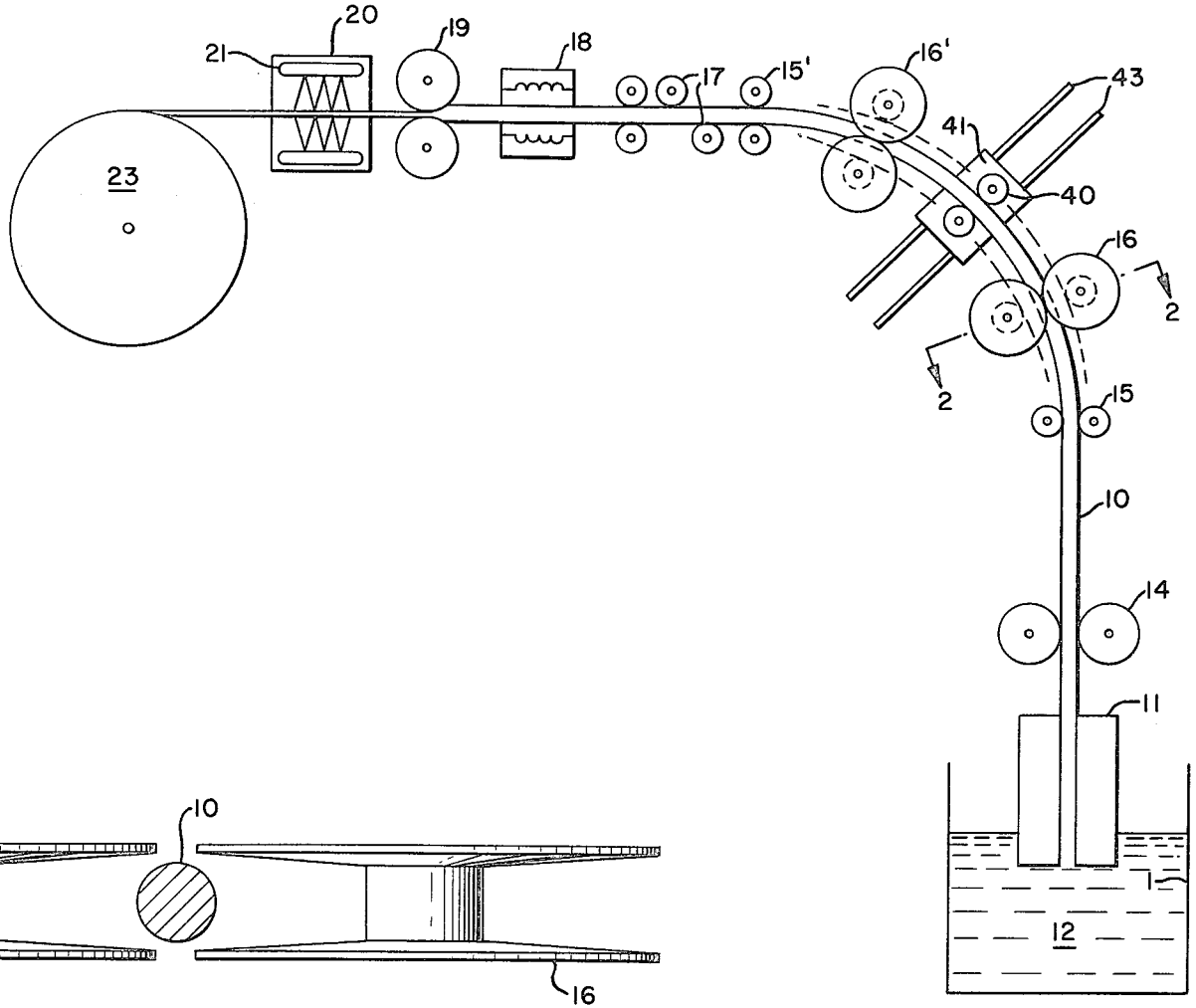
FIG. 1 is a simplified diagrammatic illustration of one embodiment of the present invention.

Referring to FIG. 1, metallic rod 10 is being withdrawn through stationary chilled mold 11 immersed in melt 12. The melt, preferably copper or a copper alloy including brass, is contained within a casting furnace. Rod 10 is withdrawn in a pattern of forward and reverse strokes by means of withdrawal rolls 14 which frictionally engage the rod. The rolls are preferably driven by a reversible hydraulic motor (not shown) under the direction of a conventional electronic programmer (not shown), allowing for a wide range of variation in the duration, velocity and acceleration of both forward and reverse strokes of the rod 10 as well as dwell periods of no motion of rod 10 relative to withdrawal wheels 14.

Guide rolls 15, 15' arranged on an arcuate path change the direction of rod travel by, for example, 90°. This change in direction of travel allows slack to develop through lateral deflection of rod 10 near the midpoint of the arcuate path. Slack is necessary so that rod speed, varying upon emergence from the chilled mold because of intermittent withdrawal can be made constant for processing into strip.

Figure 2:
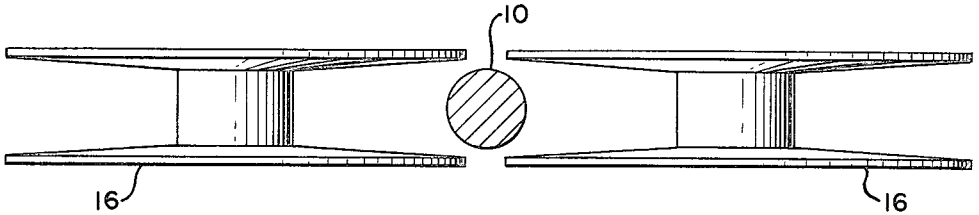
FIG. 2 is a view along line 2—2 of FIG. 1.

The slack is accommodated by rolls 16, 16' which have deeply recessed grooves in their circumferential faces, FIG. 2. The grooves thus restrain the rod in a direction perpendicular to the plane of FIG. 1, while allowing rod deflection in the plane of FIG. 1.

Located between the slack accommodating rolls 16, 16' are slack controlling rolls 40 mounted on block 41 which remain in constant communication with rod 10. Block 41 and thus rolls 40 are arranged to move laterally along guides 43 as rod 10 deflects in creating the slack, and thus the lateral position of rolls 40 is a measure of the displacement of rod 10 relative to its centered location shown in solid. The extreme positions of rod 10 are shown by the dotted lines. A transducer (not shown) coupled to block 41 signals the position of rolls 40, and this signal is used to vary the speed of the rolling mill rolls 19. The speed of rolls 19 is adjusted to match the net casting withdrawal speed multiplied by a reduction constant, thereby bounding the extent of lateral deflection of rod 10.

Rod 10 is straightened as it passes through a series of straightening rolls 17 and guided to reheating chamber 18 where it is reheated to a temperature for hot rolling. From reheating chamber 18, the rod passes through rolling mill 19 where it is flattened into strip. Thereafter, the strip is quenched in quench chamber 20. Perforated manifolds 21 within quench chamber 20, supplied with water by conventional means (not shown) spray strip 10 as it passes through. Beyond the quench chamber, the strip is coiled by a winder 23.

Figure 3:
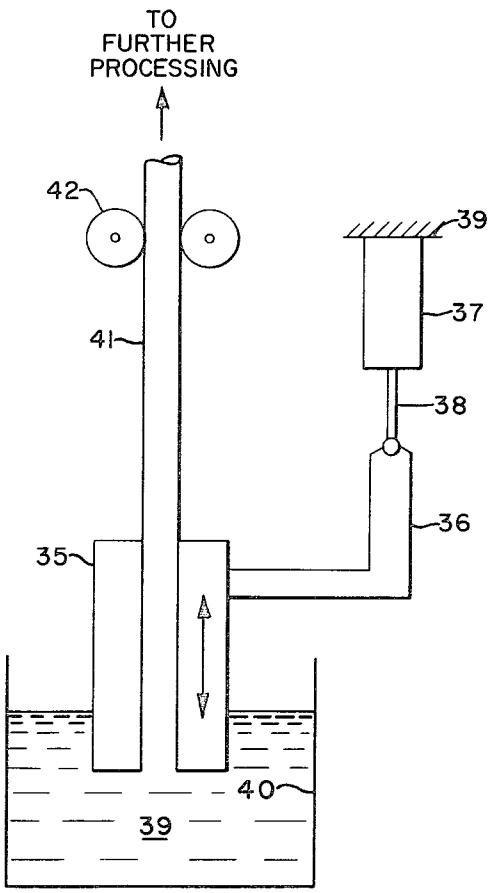
FIG. 3 is a simiplified view of an oscillating mold assembly for use in another embodiment of the present invention.

Referring now to FIG. 3, another important embodiment of the invention is shown in which chilled mold 35 is supported by arm 36 which in turn is attached to piston shaft 38 of hydraulic cylinder 37. It is understood that other linear actuates can be used. Hydraulic cylinder 37 is attached rigidly to an external structure 39. Mold 35, immersed in melt 39 contained within casting furnace 40, is thus movable co-linearly with rod 41. An electronic programmer (not shown) controls the motion of arm 36 through conventional automatic control techniques. Specifically, mold 35 is caused to oscillate about a fixed reference position. Drive rolls 42 frictionally engage rod 41, advancing it at a constant speed with respect to the same fixed reference position. Drive rolls 42 may also serve as rolling mills. A tachometer (not shown) on the rod 41 below the drive rolls 42 provides a signal to control roll velocity as a function of reduction ratio; this allows casting withdrawal rate to be controlled as required. Thus, the combination of mold oscillation and constant speed rod advancement creates the necessary forward and reverse strokes for rod production. A dwell period of no relative motion between mold and rod may also be programmed. By oscillating the mold, the need for changing the direction of travel of the rod to permit slack is thus eliminated. Of course the direction of travel of the rod 41 may be changed if desired. The rolling mill or drive rolls 42 advance the rod 41 for processing into strip. Such processing includes the same steps as the embodiment illustrated in FIG. 1.

Figure 4:
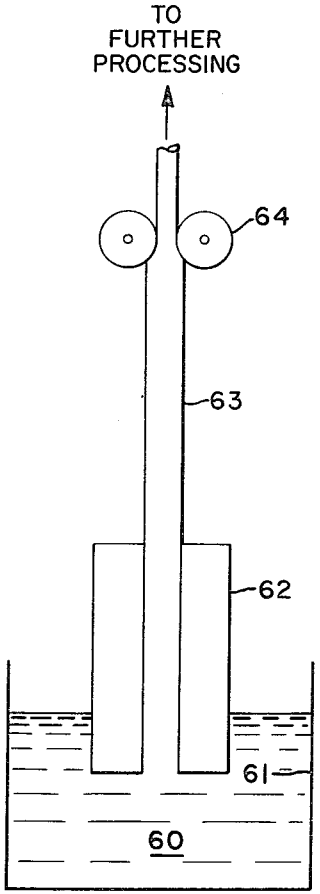
FIG. 4 is a simplified view of yet another embodiment of the invention.

In yet another embodiment of the invention, as shown in FIG. 4, melt 60 is held within furnace 61. Driven rolls 64 withdraw rod 63 through chilled mold 62 in a pattern of forward and reverse strokes. Rolls 64 are also rolling mill rolls, so that rod 63 is flattened into strip as it passes between rolls 64. Beyond rolls 64 the strip passes through further processing steps for conversion into finished strip.

The invention is further illustrated by the following nonrestrictive example. Referring to FIG. 1, a 2,400 pound melt 12 is heated in a furnace to a temperature of 2,000° F. The nominal composition of melt 12 is 70% by weight copper and 30% by weight zinc. Using the chilled cooler body 11 as set forth in copending application Ser. No. 928,881, a three-quarter inch diameter rod is cast in the upward direction. Of course, it should be noted that as to the continuous production of brass strip it does not matter in which direction the rod 14 is cast. Thus, the rod may be side cast, bottom cast, or up cast.

The average speed of rod 14 out of the chilled cooler body 11 is about 135 inches per minute. However, the rod is actually withdrawn in a pattern of forward and reverse strokes in accordance with the program set forth below.

| Program | |
|---|---|
| Forward Time | 0.3 sec |
| Forward Dwell Time | .088 sec |
| Reverse Time | .055 sec |
| Reverse Dwell Time | .085 sec |
| Forward Speed | 5.0 IPS |
| Reverse Speed | 3.0 IPS |
| Positive Accel. | 1.45 g |
| Negative Accel. | 3.0 g |
| Forward Stroke, In. | 1.451 |
| Reverse Stroke, In. | .145 |
| Frequency, Hz | 1.8 |
| Strand Speed, IPM | 135 |

The temperature of the rod 10 at withdrawal rolls 14 is 1450° F. Withdrawal rolls 14 are about 52 inches from the top of the cooler body. The distance from withdrawal rolls 14 to the front door of reheater 18 is about 91 inches. The temperature of the rod at the reheater door is about 1050° F. The temperature of the rod in the reheater is increased to about 1475° F. The hot rolling mill 19 is about 23 inches from the rear door of reheater 18. After exiting from the hot rolling mill, the rod is continuous flattened into a strip. The dimensions of the strip is 0.080 inches thick and 2.135 inches wide. It should be noted that any high torque hot rolling mill can be utilized to flatten rod 10 into strip. The particular mill used in this embodiment has a torque of 10,000 foot-pounds and exerts a separating force of 75,000 pounds.

There has been described apparatus and method for integrated, continuous, high speed manufacture of metallic strip from a melt. This invention allows the manufacture of strip at many times the rate of conventional processes and eliminates many of the steps and time delays formerly necessary.

While the invention has been described with reference to its preferred embodiments, it is to be understood that modifications and variations will occur to those skilled in the art. Such modifications and variations are intended to fall within the scope of the appended claims.

What is claimed is:

1. A method for the continuous production of metallic strip from a melt comprising:

(1) continuously casting a metallic rod from said melt in a pattern of forward and reverse stroke with respect to a continuous casting mold, (2) continuously transforming the forward and reverse strokes of said rod to a forward motion having a substantially constant forward velocity, and (3) continuously hot rolling said continuously produced rod into finished strip, said casting step, transforming step and hot rolling step being performed to act on a metal rod which is continuous from said mold through said hot rolling step to continuously form an integrated strip.

2. The method of claim 1 wherein said rod is cast through a stationary up-casting chilled mold in liquid communication with said melt and said rod is drawn through said stationary mold creating the pattern of forward and reverse strokes.

3. The method as set forth in claim 2 wherein said transforming step is accomplished by:

(1) changing the direction of travel of said rod after emergence from said chilled mold, (2) permitting slack through lateral deflections of said rod, and (3) advancing said rod in a manner to control said slack.

4. The method as set forth in claim 3 wherein said direction of travel of said rod is changed by feeding said rod to a plurality of guide rolls arranged in an arcuate path thereby causing said rod to follow said arcuate path.

5. The method as set forth in claim 4 wherein slack is permitted by feeding said rod to one or more pairs of slack accommodating rolls arranged near the mid-point of said arcuate path which are adapted to restrain said rod in a direction parallel to the axis of said slack accommodating rolls while allowing deflection of said rod in a direction perpendicular to the axis of said slack accommodating rolls.

6. The method as set forth in claim 5 wherein said rod is advanced to control said slack by varying the speed of rolling mill rolls in response to the magnitude of said lateral deflections to match the rod speed to the net casting speed of said rod multiplied by reduction constant, thereby maintaining said lateral deflections near a fixed reference position.

7. The process as set forth in claim 6 wherein said strip after being hot rolled is quenched in a quenching chamber and is wound by a winder.

8. The method as set forth in claim 7 wherein said arcuate path extends 70° to 110°.

9. The method as set forth in claim 8 wherein said accommodating rolls are disc-like and have deeply recessed grooves in the circumferential faces, said grooves accepting lateral deflections of said rod creating said slack.

10. An apparatus for integrated, continuous manufacture of hot rolled metallic strip from a melt comprising:

(1) casting means for continuous production of metallic rod from the melt, said casting means including means for producing forward and reverse motion of said rod with respect to said casting means, (2) means cooperating with said casting means for continuously transforming the forward and reverse rod motion to a forward motion having a substantially constant forward velocity being said rod is converted to strip, and (3) processing means cooperating with said casting means and transforming means for continuous conversion of said rod to said hot rolled strip, said casting means, means for transforming forward and reverse rod motion and processing means being arranged to act on a metallic rod which is continuous from said casting means through said processing means to continuously form an integrated metallic strip.

11. The apparatus of claim 10 wherein said casting means comprises a stationary casting chilled mold communicating with said melt, said means for producing forward and reverse motion of said rod comprises a driven withdrawal roll in conjunction with a pinch roll to draw said rod through said mold in a pattern of forward and reverse strokes; and said processing means comprises a rolling mill adapted for flattening said rod, thereby to convert said rod into said strip.

12. The apparatus of claim 10 wherein said processing means comprises:

(1) a quench chamber for quenching said strip, and (2) winding means for coiling said finished strip.

13. The apparatus of claim 10 wherein said casting means comprises a stationary casting chilled mold communicating with said melt, and wherein said means for transforming said forward and reverse rod motion comprises:

(1) means for changing the direction of travel of said rod after emergence from said drawing means, (2) means permitting slack through lateral deflection of said rod, and (3) means for advancing said rod in the manner to control said slack.

14. The apparatus of claim 13 wherein said means for changing said direction of travel of said rod comprises a plurality of guide rolls arranged on an arcuate path thereby causing said rod to follow said arcuate path.

15. The apparatus of claim 14 wherein said arcuate path extends 70°–110°.

16. The apparatus of claim 14 wherein said means permitting said slack comprises one or more pairs of slack accomodating rolls arranged near the mid-point of said arcuate path which are adapted to restrain said rod in a direction parallel to the axis of said slack accommodating rolls while allowing deflection of said rod in a direction perpendicular to the axis of said slack accommodating rolls.

17. The apparatus of claim 16 wherein said means for advancing said rod to control said slack comprises varying the speed of rolling mill rolls in response to the magnitude of said lateral deflection to match said rod speed to the net casting speed of said rod multiplied by a reduction constant, thereby to maintain said lateral deflection near a fixed reference position.

18. The apparatus of claim 16 wherein said slack accommodating rolls are disc-like and have deeply recessed grooves in their circumferential faces, said grooves accepting lateral deflections of said rod creating said slack.

19. Apparatus for integrated, continuous high speed manufacture of hot rolled metallic strip from a melt comprising:

a stationary, up-casting chilled mold communicating with said melt for casting metallic rod;

one or more pairs of rolls gripping said rod and driven in a controlled way to draw said rod through said mold in a pattern of forward and reverse strokes;

a plurality of pairs of guide rolls for guiding said rod and arranged in an arcuate path for changing the direction of travel to said rod;

one or more slack accommodating rolls arranged near the mid-point of said arcuate path and adapted to restrain said rod in a direction parallel to the axis of said slack accommodating rolls while allowing deflection of said rod in a direction perpendicular to the axis of said slack accommodating rolls thereby permitting slack through lateral deflection of said rod;

a pair of slack control rolls disposed near the mid-point of said arcuate path and in constant communication with said rod arranged to move laterally with said rod in response to said deflection;

a pair of variable speed driven rolls for advancing said rod, the speed of said rolls varied according to the magnitude of said deflection thereby to bound said deflection;

a reheating device for raising the temperature of said rod for hot rolling;

a hot rolling mill for converting said rod into said strip;

a quench chamber for quenching said strip; and a winding means for coiling said strip.

20. An apparatus for intergrated, continuous manufacture of hot rolled metallic strip from a melt comprising:

(1) casting means for continuous production of metallic rod from the melt, said casting means comprising a stationary casting chilled mold communicating with said melt, and including means for drawing said rod through said mold in a pattern of forward and reverse strokes with respect to said casting means; and (2) processing means cooperating with said casting means for continuous conversion of said rod to said hot rolled strip, said processing means comprising:

(A) means for changing the direction of travel of said rod after emergence from said drawing means, said means for changing said direction of travel of said rod comprising a plurality of guide rolls arranged on an arcuate path thereby causing said rod to follow said arcuate path, (B) means permitting slack through lateral deflection of said rod, said means permitting said slack comprising one or more pairs of slack accommodating rolls arranged near the mid-point of said arcuate path which are adapted to restrain said rod in a direction parallel to the axis of said slack accommodating rolls while allowing deflection of said rod in a direction perpendicular to the axis of said slack accommodating rolls, (C) means for advancing said rod in the manner to control said slack, and (D) rolling means for converting said rod to said strip.

21. The apparatus of claim 20 wherein said means for advancing said rod to control said slack comprises varying the speed of rolling mill rolls in response to the magnitude of said lateral deflection to match said rod speed to the net casting speed of said rod multiplied by a reduction constant, thereby to maintain said lateral deflection near a fixed reference position.

22. The apparatus of claim 20 wherein said processing means also comprises:

(1) a hot rolling mill for converting said rod into said strip, (2) a quench chamber for quenching said strip, and (3) winding means for coiling said finished strip.

23. The apparatus of claim 20 wherein said slack accommodating rolls are disc-like and have deeply recessed grooves in their circumferential faces, said grooves accepting lateral deflections of said rod creating said slack.

* * * * *